United States Patent [19]

Pierce

[11] 4,374,514

[45] * Feb. 22, 1983

[54] FIREPLACE HEATER STOVE

[76] Inventor: Harold W. Pierce, Ellicott City, Md.

[ * ] Notice: The portion of the term of this patent subsequent to Oct. 28, 1997, has been disclaimed.

[21] Appl. No.: 360,076

[22] Filed: Mar. 19, 1982

Related U.S. Application Data

[63] Continuation-in-part of Ser. No. 59,658, Jul. 23, 1979, Pat. No. 4,320,741.

[51] Int. Cl.[3] ..... F24C 1/14

[52] U.S. Cl. ..... 126/123; 126/121; 126/138; 126/61; 126/63

[58] Field of Search ..... 126/136, 123, 121, 120, 126/138, 139, 61, 76, 77, 140, 5, 52, 53, 110 B, 6, 63, 64, 66, 67, 88, 89, 90 R, 126; 237/51

[56] References Cited

U.S. PATENT DOCUMENTS

| | | | |
|---|---|---|---|
| 543,742 | 7/1895 | Loy et al. | 126/61 |
| 1,044,724 | 11/1912 | Atteberry | 126/76 |
| 1,255,493 | 2/1918 | Williams | 126/121 |
| 1,649,881 | 11/1927 | Williamson | 126/121 |
| 2,033,911 | 3/1936 | Digby | 126/5 |
| 2,703,567 | 3/1955 | Manchester et al. | 126/121 |
| 2,789,554 | 4/1957 | Dupler | 126/63 |
| 4,096,849 | 10/1977 | Moncrieff-Yates | 126/121 |
| 4,128,094 | 12/1978 | Lewis | 126/110 B |
| 4,136,662 | 1/1979 | Willson | 126/61 |
| 4,140,101 | 2/1979 | Glover | 126/61 X |
| 4,233,955 | 11/1980 | McCallum et al. | 126/61 |

OTHER PUBLICATIONS

Preway Chimney Book No. F2981-4, Preway Company, Wisconsin Rapids, WI 54494.

Superior Fireplace Company, "E-Z Heat"advertisement brochure.

*Primary Examiner*—Larry Jones

*Attorney, Agent, or Firm*—Marc Sandy Block

[57] ABSTRACT

A heater stove which fits into a fireplace, the heater stove comprising a cylindrical firebox having (a) a front face, a back face, and a side wall, with a first closed-curve cross-section, extending between the front face and the back face and (b) an axis directed into the fireplace when the heater stove is within the fireplace; an outer cylindrical shell having a side wall with a second closed-curve cross-section and a back wall, the shell surrounding and being spaced apart from the back face and the side wall of the firebox, the side wall of the shell and the side wall of the firebox having a gap therebetween the gap including an opening at the front of the stove; and means for angularly dividing the gap proximate the opening into a plurality of regions which extend a short distance in the axial direction between the firebox side wall and the shell side wall, the regions including at least one lower region into which unheated air is drawn and at least one upper region from which heated air exits, air drawn through the at least one lower region (a) mixing with air flowing in other of the regions, (b) being heated by the firebox, and (c) exiting through at least one of the at least one upper regions. The first and second closed-curve cross-sections may alternatively be the same or different.

7 Claims, 10 Drawing Figures

FIREPLACE HEATER STOVE

RELATED APPLICATIONS

This application is a continuation-in-part of my copending application Ser. No. 59,658 filed on July 23, 1979 and entitled "Fireplace Heater Stove" now U.S. Pat. No. 4,320,741.

TECHNOLOGICAL CONTEXT OF THE INVENTION

In response to the desires and needs of an energy-consuming public, various wood-burning heating systems - some of which fit into fireplaces - have been and are being developed.

One such apparatus, disclosed by Loy et al in U.S. Pat. No. 543,702, discloses a cylindrical fire-chamber contained within a cylindrical casing to provide convection heating. The airflow in Loy et al, however, is through "inlet and outlet perforations " which restrict not only the amount of air entering the heating apparatus but also the area of the inner fire-chamber over which the air flows and convection produced. Fitting the Loy et al apparatus into a fireplace is not contemplated.

Also showing two concentric cylindrical elements in a wood-burning convection heater, Lewis in U.S. Pat. No. 4,128,094 teaches air flow about the circumference of the inner portion of the structure (shown by arrows 8). Lewis does not readily adapt to being fit into a fireplace.

A patent (U.S. Pat. No. 1,255,493) by Williams shows a heater fit into a fireplace wherein cold air is drawn in at a bottom grating and air, heated by convection, is forced out through a top grating. The heater of Williams is rectangular and provides flues which directs, but nonetheless restricts, air flow.

Moncrieff-Yates (U.S. Pat. No. 4,096,849), like Williams, shows another fireplace unit which is not cylindrical and sends heat convected air through a duct. Moncrieff-Yates channels air over a bed plate, the angle of which is of great significance.

Techniques currently used fail to provide unobstructed, even heating to a flow of air passing through an air gap between two concentric cylinders, the inner cylinder being a firebox enclosed on all sides except for a flue which enters a fireplace chimney. Further, none of the techniques employ the gap between two cylinders—rather than ducts, pipes, or gratings—to provide a path for air to be heated.

No suggested apparatuses provide for retrofitting a wood-burning stove into fireplaces of a variety of sizes. Nor do these apparatuses teach the large surface area of heating, the smooth airflow resulting from air passing rounded surfaces, and the safety of recessing the hot inner cylinder and permitting only the warmer outer cylinder to jut out.

SUMMARY OF THE INVENTION

To improve and enhance heaters proposed by others, the present invention provides an inner cylindrical wood-burning firebox sealable except for an exit flue going into a fireplace chimney and surrounded by an outer cylindrical shell both open at the front and separated from the walls and back of the firebox by an air gap. The firebox and outer shell fit into a fireplace, a large plate being attached to the exterior of the outer shell and set to one of various axial positions along the outer shell and being affixed to the fireplace.

The firebox is provided with a through-draft and a Venturi down-draft air inlet to enhance the heating therein. A baffle is also included to direct gas flow for secondary burn.

Finally, the provision of a coil, through which heatable fluid flows, wound about the firebox to yield a total, combination heating unit is specifically discussed.

The present invention, due to its structure and the direction of airflow (parallel to the axis of the firebox and outer shell), provides even and continuous heating.

The outer shell protrudes relative to the firebox. The possibility of an object or person touching the hot, recessed firebox is greatly diminished. The outer shell does not get hot enough to scar if touched or set an object afire. Enhanced safe operation is thus an object of the invention.

Being cylindrical, wood as it burns moves to the center of the "floor" of the firebox, leading to more thorough burning in certain embodiments.

Finally, the present invention is aesthetically pleasing and can be readily used in many houses as a fireplace insert or free-standing stove without requiring modifications to the house.

DESCRIPTION OF THE INVENTION

Figure 1:
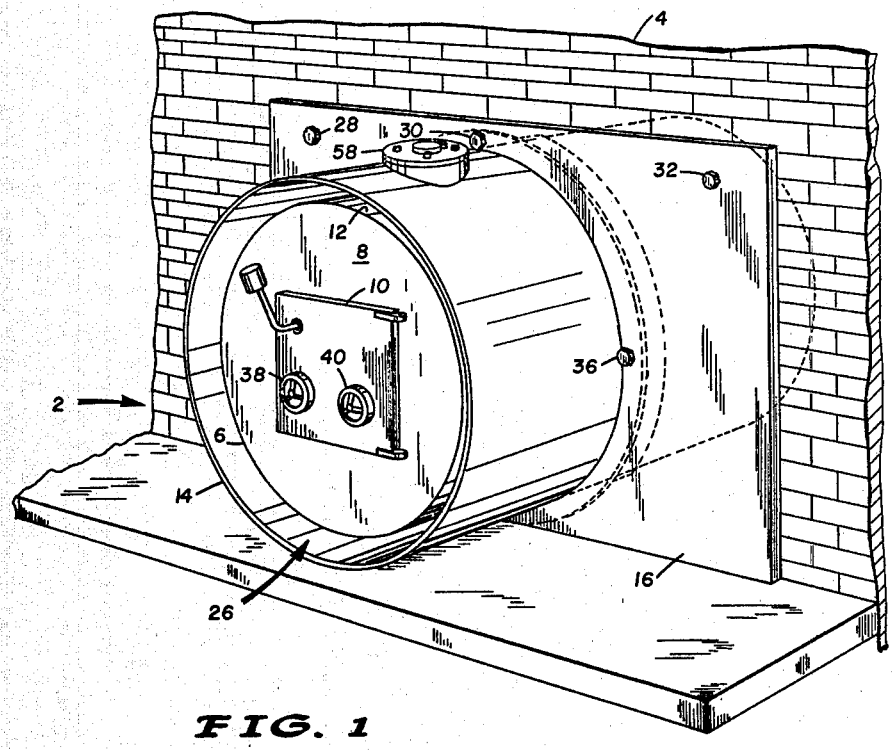
FIG. 1 is a perspective drawing showing the fireplace stove of the invention fit into a fireplace.
Figure 2:
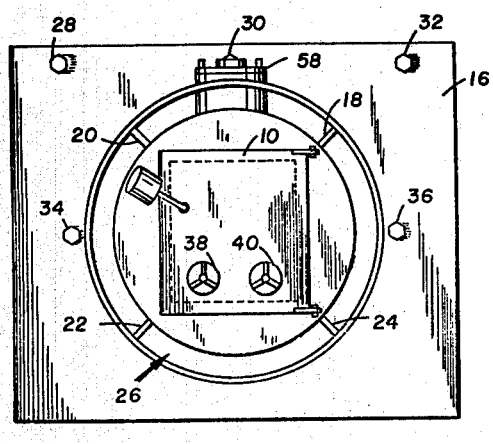
FIG. 2 is a front view of the present invention.
Figure 4:
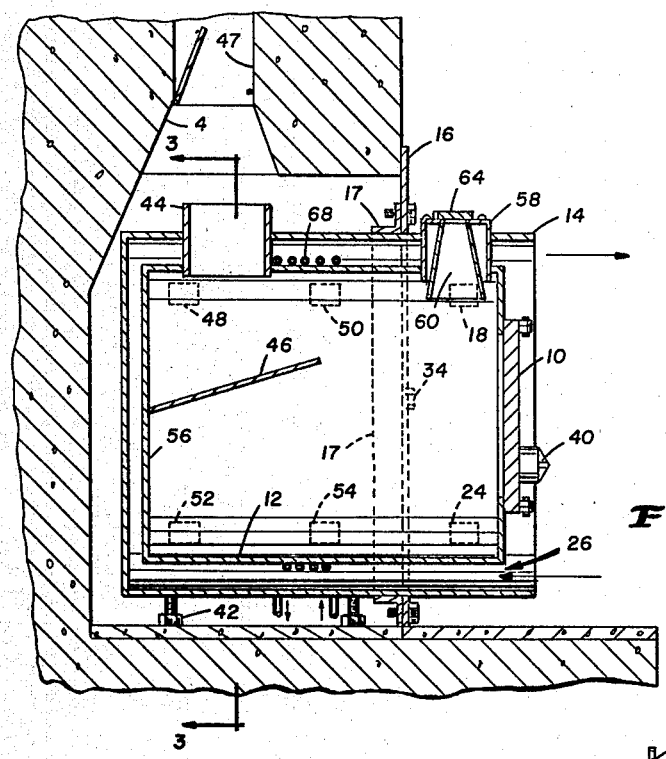
FIG. 4 is a cutaway side-view of the invention showing an inner cylindrical firebox contained within an outer cylindrical enclosure.
Figure 5:
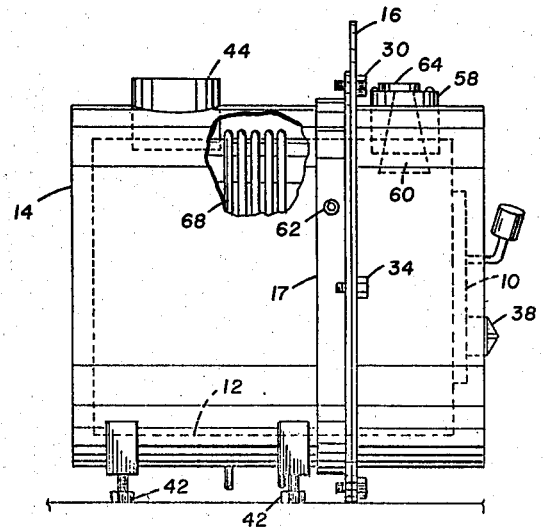
FIG. 5 is a cutaway side-view of an embodiment of the invention which includes a wraparound coil element.

Referring to FIG. 1, the heater stove 2 of the present invention is shown in its environment, fit into a fireplace 4. A firebox 6 is shown having a cylindrical side wall 2, a rear face 9, and a front face 8 in which a door 10 is placed, the cylindrical wall 12 (see FIGS .4 and 5) extending into the fireplace 4. Surrounding the firebox 6 is an outer cylindrical shell 14 which has a rear face 15 and no front face and which is connected to a front plate 16. It is noted that an optional down draft element 58 and a stove-pipe 44 pass through the firebox 6 and the shell 14 at two points, as shown in FIGS. 4 and 5. Except for these two locations, the side wall 12 of the firebox 6 and the side wall 19 of the cylindrical shell 14 each have a closed-curve cross-section. Specifically, in FIGS. 1 through 5 both side walls 12 and 15 have circular cross-sections. In addition, it is noted that the rear face 9 and side wall 12 of the firebox 6 are surrounded or enclosed by the rear face 15 and side wall 19 of the shell 14. Heat transfer from the rear face 9 and side wall 12 is thus realizable.

The front plate 16 is sealedly affixed to the fireplace 4. The firebox 6 and the outer shell 14 are shown connected to each other by brackets 18, 20, 22, and 24. A gap 26, between the firebox 6 and the outer cylindrical shell 14, in FIG. 1 is also shown in the front view of FIG. 2 and the cutaway front view of FIG. 3. Bolts 28 and 32 (also shown in FIG. 2) are provided in FIG. 1 for affixing the front plate 16 to the outer cylindrical shell 14. In both FIG. 1 and FIG. 2 through-draft elements 38 and 40 are shown located in the door 10. In a preferred embodiment, the through-draft elements 38 and 40 can screw and unscrew to cover or uncover an air opening (not shown), thereby allowing less or more air to enter the firebox 6.

Figure 3:
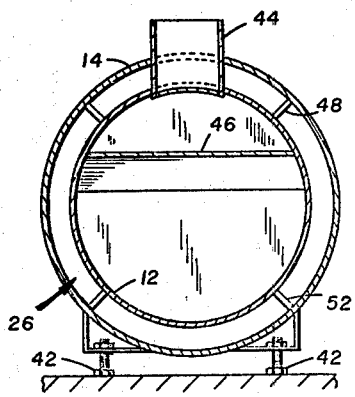
FIG. 3 is a cutaway front view of the present invention.

FIG. 3, which illustrates a front view cut away behind the front plate 116, shows legs 42 on which the outer cylindrical shell 14 rests. The stove-pipe 44 passes through a hole in the top of the outer cylindrical shell 14 and through a hole in the top of the firebox 6. A baffle 46 is more clearly seen in the side view of FIG. 4, which also shows the stove-pipe 44 entering the chimney 47 of the fireplace 4.

Referring to FIG. 4, it is readily seen how the baffle 46 causes gases in the firebox 6, generated when wood is burned therein, to circulate and promote secondary burning within the firebox 6, The baffle 46, together with the cylindrical shape of the firebox 6, contributes to the complete and efficient burning of the wood fuel. In the view of FIG. 4, additional brackets 48, 50, 52, and 54 are shown on the right side connecting the firebox 6 to the outer cylindrical shell 14. A similar bracket arrangement would also be provided on the left side.

It should be noted that the function of these brackets is mainly to provide a support and connection between the firebox 6 and outer cylindrical shell 14 and may, therefore, include any number or arrangement of brackets which do not notably obstruct the flow of air passing between the firebox 6 and shell 14. Thus, although the brackets 18 through 24 define arcuate regions at the opening to the air-gap 26 into which air to be heated enters or from which heated air from the stove 2 exits, or both, the brackets 18 through 22 are of minimal length so as not to significantly affect air flow. Similarly, their design also promotes unhampered air flow. Accordingly, the brackets 18 through 22 may be disposed as desired at various angular positions (see FIGS. 8 through 10).

In operation, wood (not shown) is burned in the firebox 6 (of FIG. 4). Through-draft 38 is opened as desired to feed in air. The air in the firebox 6 circulates due to the baffle 46 heating the cylindrical wall 12 as well as the back face 56 of the firebox 6. Chimney smoke passes to the chimney 47 via stovepipe 44. As the firebox 6 heats, cool room air enters the bottom of the gap 26 as indicated by the dashed arrow. The cool air travels to the rear of the heater stove 2 and is heated by the firebox 6 as it travels. As the heated air moves toward the rear of the heater stove 2 it rises. The heated air is expelled throughout the top portion of the gap 26 as shown by the dashed arrows.

With regard to this air flow it should be understood that the bottom portion of the gap 26 comprises approximately the lower half of the gap 26 while the top portion comprises approximately the upper half. The top and bottom portions may be defined with reference to the above-mentioned brackets 18 through 22 which define regions of air infow and outflow at the opening of the gap 26. Convection currents, it should be noted, need not flow straight back and straight out (as illustrated by the dashed arrows) but may also follow curved flow paths, the rising of the air as it passes to the rear depending on the heat in the firebox 6 and the temperature in the room among other factors.

Figure 6:
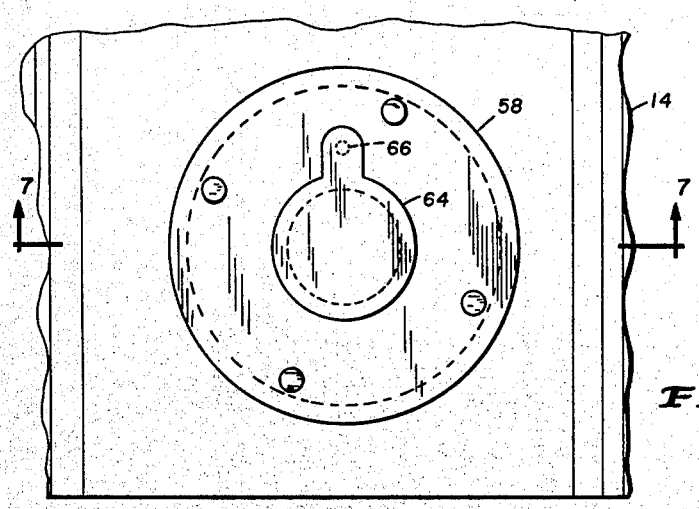
FIG. 6 is a top-view enlargement of a down draft valve shown in FIG. 5.
Figure 7:
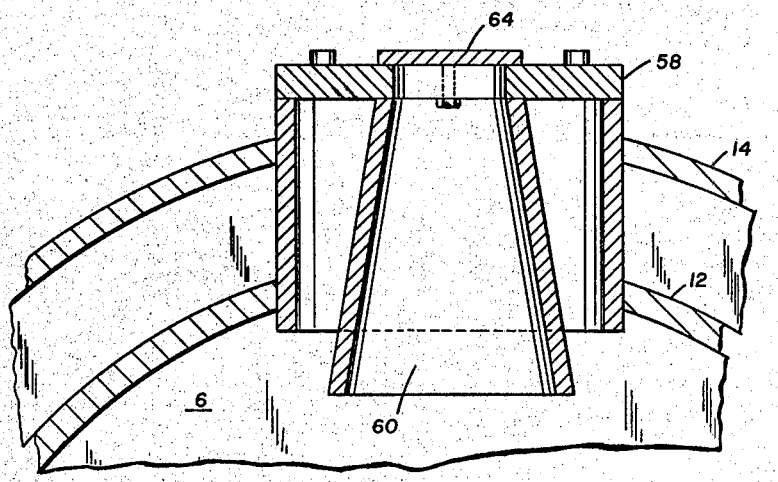
FIG. 7 is a front-view enlargement of a down draft valve shown in FIG. 5.

Referring now to FIG. 5, another embodiment of the invention is shown in cutaway side view. In addition to through-draft elements 38 and 40, a down-draft element 58 with a Venturi aperature 60 is included to inject a controlled stream of room air into the firebox 6 as desired. The exact structure of the down-draft element 58 is depicted in FIGS. 6 and 7. The top view of FIG. 6 shows a cover 64 which can rotate about a pivot point 66 to expost the Venturi aperature 60 to greater air inflow. FIG. 7 shows the round Venturi aperature 60 surrounded by a pipe housing 67, extending through the outer cylindrical shell 14 and the cylindrical wall 12 into the firebox 6.

Referring back to FIG. 5, the heater stove 2 is shown having fluid carrying tubing 68 wound about the firebox 6 inside the outer cylindrical shell 14. Cold gas or water pumped through the tubing 68 will be heated. A combination air convection heater and hot water heater, for example, can be provided by the embodiment of FIG. 5. An adjustment screw 62 (or screws), of preferably an Allen head type, passes through the flanged ring 17 to contact outer cylindrical shell 14 and is used to permit motion of the outer cylindrical shell 14 relative to the front plate 16, i.e., into or out from the fireplace 4. To fit into a deeper fireplace, the adjustment screw(s) 62 may be loosened, the firebox 6 and outer cylindrical shell 14 pushed deeper (i.e., to the left in FIGS. 4 and 5) into the fireplace 4, and the adjustment screw(s) 62 retightened.

Figure 8:
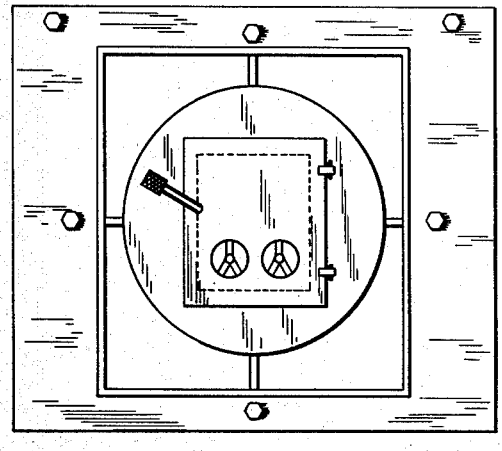
FIG. 8 through 10 are front views of three alternative embodiments of the invention.
Figure 9:
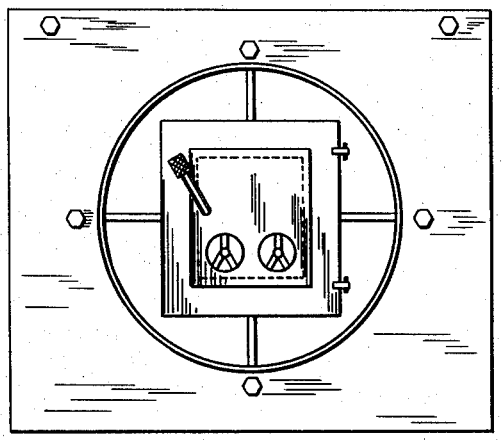
Figure 10:
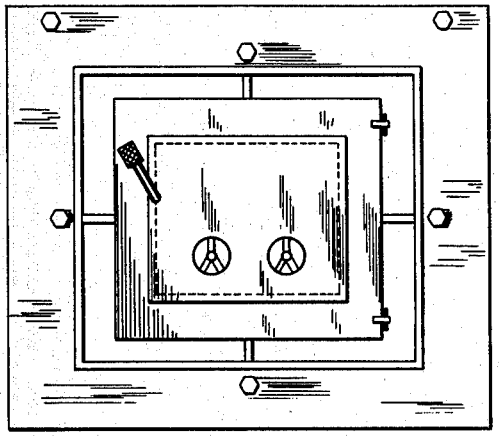
Figure 8:
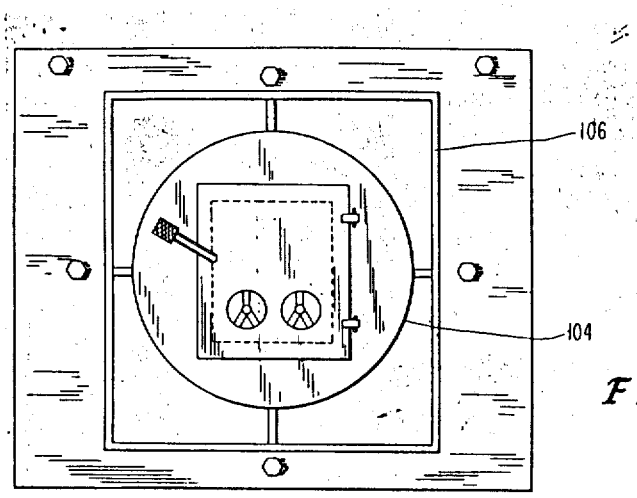
Figure 9:
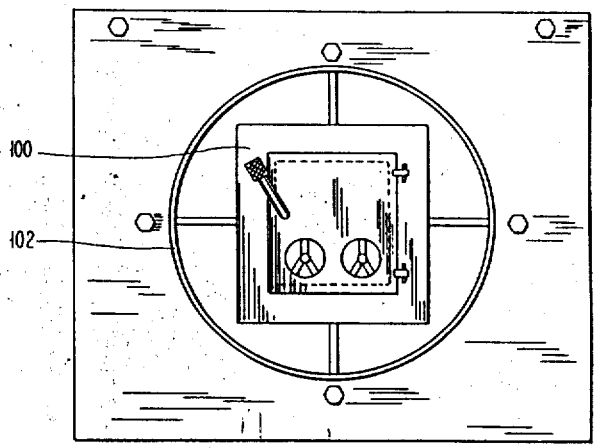
Figure 10:
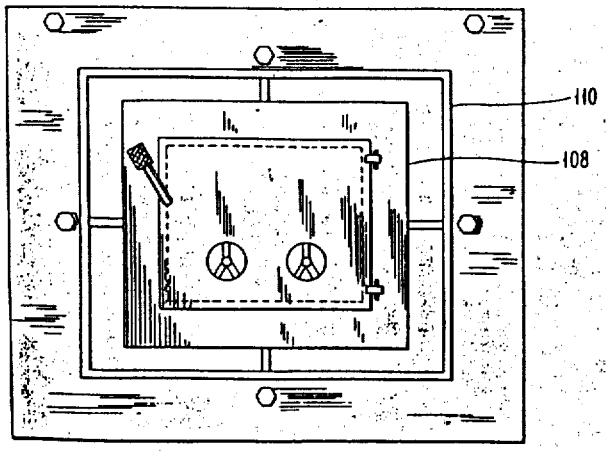

It should be realized that, although the present invention shows a circular cylinder embodiment, other cylindrical embodiments (such as elliptical or squared) are also within the scope of the invention. In this regard, FIGS. 8 through 10 illustrate alternative embodiments wherein the transverse cross-section of the firebox 6 and the transverse cross-section of the shell 14 have shapes other than circular. FIGS. 8 and 10 show that the two cross-sections need not be similar. A polygonal cross-section firebox 100 can be surrounded by a rounded cross-section shell 102 or, conversely, a rounded cross-section firebox 104 can be surrounded by a polygonal, e.g. rectangular or square, cross-section shell 106. As indicated in FIGS. 1 and 10, the two cross-sections may, of course, be similar, FIG. 10 illustrating a rectangular cross-section firebox 108 surrounded by a rectangular cross-section shell 110. Similarly, while the door 10 is illustrated as square, it may also be round and, if desired, large enough to comprise the front face 8 of the firebox 6. Other such modifications are also within the scope of the invention.

I claim:

1. A heater stove which fits into a fireplace, the heater stove comprising:

a cylindrical firebox having (a) a front face, a back face, and a side wall, with a first closed-curve cross-section, extending between the front face and the back face and (b) an axis directed into the fireplace when the heater stove is within the fireplace;

an outer cylindrical shell having a side wall with a second closed-curve cross-section and a back wall, the shell surrounding and being spaced apart from the back face and the side wall of the firebox, the side wall of the shell and the side wall of the firebox having a gap therebetween, the gap including an opening at the front of the stove; and means for angularly dividing the gap proximate the opening into a plurality of regions which extend a short length in the axial direction between the firebox side wall and the shell side wall, the regions including at least on lower region into which unheated air is drawn and at least one upper region from which heated air exits, air drawn through the at least one lower region (a) mixing with air flowing in other of the regions, (b) being heated by the firebox, and (c) then exiting through at least one of the at least one upper regions, air within the gap being heated by essentially the entire outer peripheral surface of the firebox.

2. A heater stove according to claim 1 wherein the first closed-curve cross-section is polygonal in shape.

3. A heater stove according to claim 2 wherein the first closed-curve cross-section is rectangular in shape.

4. A heater stove according to claim 1 wherein the first closed-curve cross-section is rounded in shape.

5. A heater stove according to claim 1, or 2 wherein the second closed-curve cross-section is similar in shape to the shape of the first closed-curve cross-section.

6. A heater stove according to claim 1, 2 or 4 wherein the second closed-curve cross-section is polygonal in shape.

7. A heater stove according to claim 1, or 2 wherein the second closed-curve cross-section is rounded in shape.

* * * * *

UNITED STATES PATENT AND TRADEMARK OFFICE

CERTIFICATE OF CORRECTION

PATENT NO. : 4,374,514

DATED : February 22, 1983

INVENTOR(S) : HAROLD W. PIERCE

It is certified that error appears in the above-identified patent and that said Letters Patent is hereby corrected as shown below:

The title page should be deleted to appear as per attached title page.

The asterisk item [*] should read:

* Notice: The portion of the term of this patent subsequent to March 23, 1999, has been disclaimed.

The sheet of Drawing consisting of Figures 8, 9 and 10 should be deleted to appear as per the attached sheet.

Column 5, line 6, claim 1, change "on" to --one--.

Signed and Sealed this

*Eleventh* Day of *June 1985*

[SEAL]

*Attest:*

DONALD J. QUIGG

*Attesting Officer* *Acting Commissioner of Patents and Trademarks*

United States Patent [19]

Pierce

[11] 4,374,514

[45] * Feb. 22, 1983

[54] FIREPLACE HEATER STOVE

[76] Inventor: Harold W. Pierce, Ellicott City, Md.

[ * ] Notice: The portion of the term of this patent subsequent to Oct. 28, 1997, has been disclaimed.

[21] Appl. No.: 360,076

[22] Filed: Mar. 19, 1982

Related U.S. Application Data

[63] Continuation-in-part of Ser. No. 59,658, Jul. 23, 1979, Pat. No. 4,320,741.

[51] Int. Cl.[3] ..... F24C 1/14

[52] U.S. Cl. ..... 126/123; 126/121; 126/138; 126/61; 126/63

[58] Field of Search ..... 126/136, 123, 121, 120, 126/138, 139, 61, 76, 77, 140, 5, 52, 53, 110 B, 6, 63, 64, 66, 67, 88, 89, 90 R, 126; 237/51

[56] References Cited

U.S. PATENT DOCUMENTS

| | | | |
|---|---|---|---|
| 543,742 | 7/1895 | Loy et al. | 126/61 |
| 1,044,724 | 11/1912 | Atteberry | 126/76 |
| 1,255,493 | 2/1918 | Williams | 126/121 |
| 1,649,881 | 11/1927 | Williamson | 126/121 |
| 2,033,911 | 3/1936 | Digby | 126/5 |
| 2,703,567 | 3/1955 | Manchester et al. | 126/121 |
| 2,789,554 | 4/1957 | Dupler | 126/63 |
| 4,096,849 | 10/1977 | Moncrieff-Yates | 126/121 |
| 4,128,094 | 12/1978 | Lewis | 126/110 B |
| 4,136,662 | 1/1979 | Willson | 126/61 |
| 4,140,101 | 2/1979 | Glover | 126/61 X |
| 4,233,955 | 11/1980 | McCallum et al. | 126/61 |

OTHER PUBLICATIONS

Preway Chimney Book No. F2981-4, Preway Company, Wisconsin Rapids, WI 54494.

Superior Fireplace Company, "E-Z Heat"advertisement brochure.

*Primary Examiner*—Larry Jones

*Attorney, Agent, or Firm*—Marc Sandy Block

[57] ABSTRACT

A heater stove which fits into a fireplace, the heater stove comprising a cylindrical firebox having (a) a front face, a back face, and a side wall, with a first closed-curve cross-section, extending between the front face and the back face and (b) an axis directed into the fireplace when the heater stove is within the fireplace; an outer cylindrical shell having a side wall with a second closed-curve cross-section and a back wall, the shell surrounding and being spaced apart from the back face and the side wall of the firebox, the side wall of the shell and the side wall of the firebox having a gap therebetween the gap including an opening at the front of the stove; and means for angularly dividing the gap proximate the opening into a plurality of regions which extend a short distance in the axial direction between the firebox side wall and the shell side wall, the regions including at least one lower region into which unheated air is drawn and at least one upper region from which heated air exits, air drawn through the at least one lower region (a) mixing with air flowing in other of the regions, (b) being heated by the firebox, and (c) exiting through at least one of the at least one upper regions. The first and second closed-curve cross-sections may alternatively be the same or different.

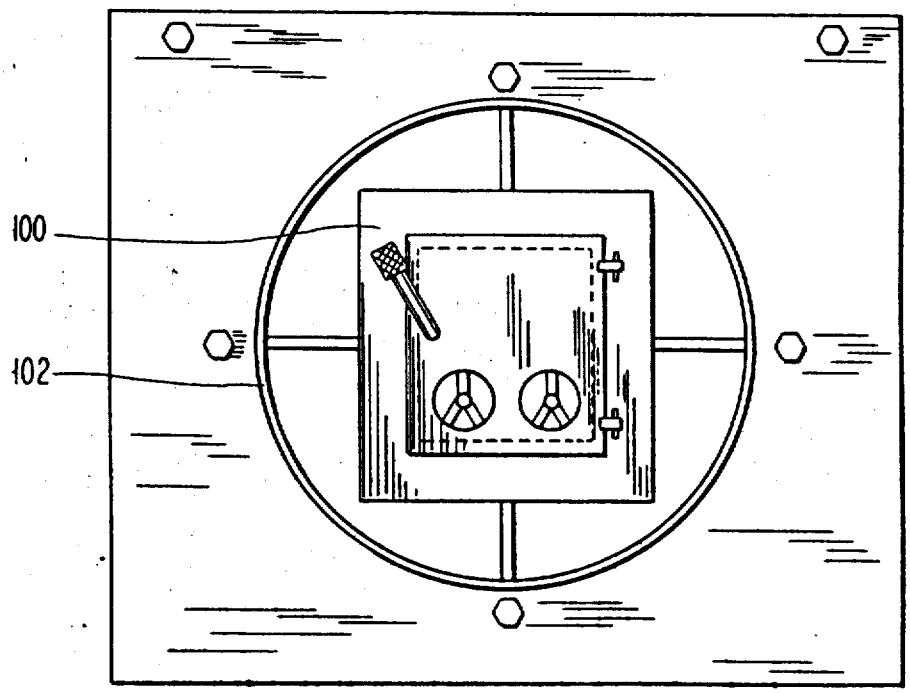

7 Claims, 10 Drawing Figures